US009395071B2

(12) United States Patent
Weekamp et al.

(10) Patent No.: US 9,395,071 B2
(45) Date of Patent: Jul. 19, 2016

(54) WIRE-BASED LIGHTING MODULE WITH 3D TOPOGRAPHY

(75) Inventors: Johannes Wilhelmus Weekamp, Beek en Donk (NL); Sebastien Paul Rene Libon, Dordrecht (NL); Gerard Kums, Molenstede (BE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 90 days.

(21) Appl. No.: 14/238,888

(22) PCT Filed: Aug. 29, 2012

(86) PCT No.: PCT/IB2012/054419

§ 371 (c)(1),
(2), (4) Date: Feb. 14, 2014

(87) PCT Pub. No.: WO2013/035012

PCT Pub. Date: Mar. 14, 2013

(65) Prior Publication Data

US 2014/0168974 A1 Jun. 19, 2014

(30) Foreign Application Priority Data

Sep. 6, 2011 (EP) ..... 11180245

(51) Int. Cl.

| | |
|---|---|
| ***F21V 23/00*** | (2015.01) |
| ***F21K 99/00*** | (2016.01) |
| ***F21V 11/00*** | (2015.01) |
| *F21Y 101/02* | (2006.01) |
| *F21Y 105/00* | (2016.01) |

(52) U.S. Cl.

CPC ..... *F21V 23/001* (2013.01); *F21K 9/30* (2013.01); *F21K 9/90* (2013.01); *F21S 4/15* (2016.01); *F21V 11/00* (2013.01); *F21V 23/00* (2013.01); *F21Y 2101/02* (2013.01); *F21Y 2105/001* (2013.01); *Y10T 29/49117* (2015.01)

(58) Field of Classification Search

CPC ..... F21V 23/001; F21V 23/002; F21V 23/00; F21S 8/026; F21Y 2101/02; F21Y 205/00; F21Y 2105/001; F21Y 2105/003; F21Y 2105/005; F21Y 2105/006; F21Y 2105/0081

See application file for complete search history.

(56) References Cited

U.S. PATENT DOCUMENTS

| | | | | |
|---|---|---|---|---|
| 3,052,004 | A * | 9/1962 | Wallshein | A61C 7/12 24/129 R |
| 7,478,925 | B2 * | 1/2009 | Hiyama | G09F 13/22 257/E25.02 |
| 8,343,783 | B2 * | 1/2013 | Lee | H05K 1/142 257/E21.499 |
| 2003/0193801 | A1 * | 10/2003 | Lin | F21S 4/007 362/555 |
| 2005/0057939 | A1 | 3/2005 | Mizuyoshi | |

FOREIGN PATENT DOCUMENTS

| | | | |
|---|---|---|---|
| DE | 202005013148 | U1 | 1/2007 |
| WO | 2007122566 | A1 | 11/2007 |
| WO | 2010132552 | A1 | 11/2010 |

* cited by examiner

*Primary Examiner* — Robert May
(74) *Attorney, Agent, or Firm* — Meenakshy Chakravorty

(57) ABSTRACT

The present invention relates to a grid-shaped lighting module (13; 23) comprising: a plurality of electrically conducting wires (15*a-b*) defining a grid with nodes (16*a-c*); and a plurality of solid-state light-sources (17*a-c*) each being arranged at a respective one of the nodes and connected to two electrically conducting wires of the plurality of electrically conducting wires. The electrically conducting wires (15*a-b*) are pleated such that the grid-shaped lighting module (13; 23) exhibits a 3D-topography. Various embodiments of the present invention provide improved mechanical stability and allows for thin illumination panels based on the grid-shaped lighting module.

11 Claims, 3 Drawing Sheets

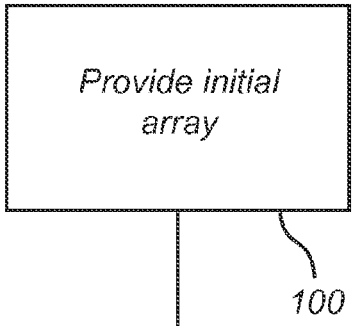
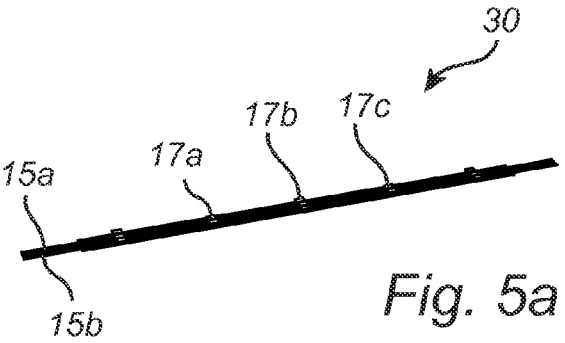
Fig. 5a
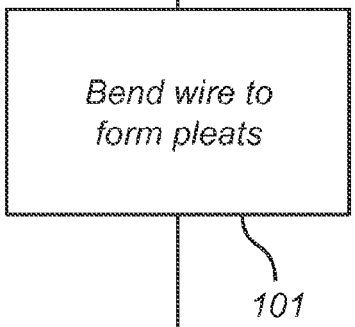
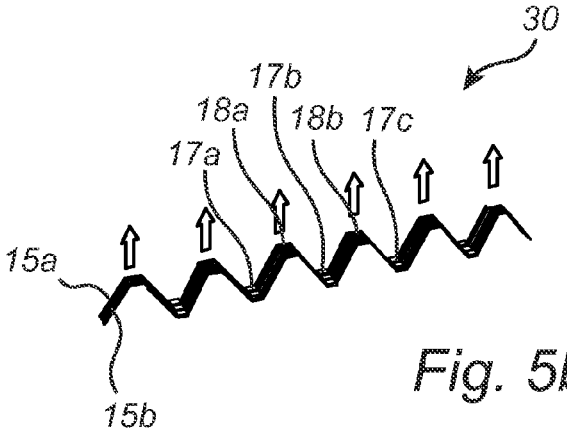
Fig. 5b
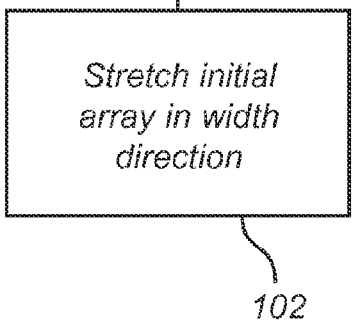
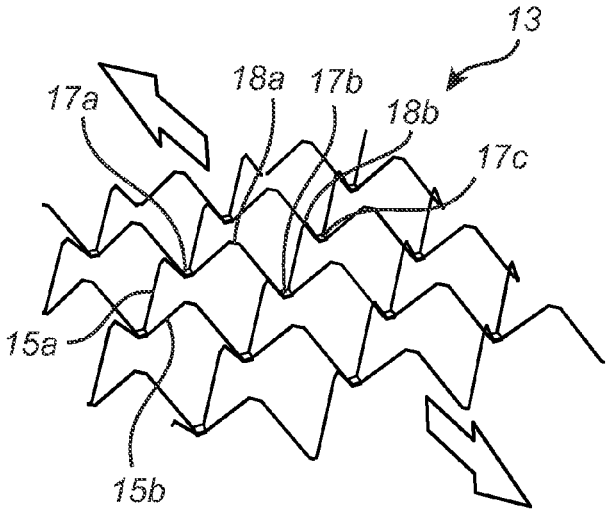
Fig. 4
Fig. 5c

WIRE-BASED LIGHTING MODULE WITH 3D TOPOGRAPHY

This application is the U.S. National Phase application under 35 U.S.C. §371 of International Application No. PCT/2012/054419, filed Aug. 29, 2012 which claims the benefit of and priority to European Patent Application No. 11180245.0, filed Sep. 6, 2011. These applications are hereby incorporated by reference herein.

FIELD OF THE INVENTION

The present invention relates to a grid-shaped lighting module and to a method of manufacturing such a grid-shaped lighting module.

BACKGROUND OF THE INVENTION

For various applications, it is desirable to provide uniform illumination over a relatively large area. Such applications, for example, include the backlight for LCD-type flat screen television sets and large area luminaires for lighting and/or ambience creation. Such uniform illumination can be achieved using conventional light-sources, such as cold cathode fluorescent lamps (CCFL). However, a CCFL-based light-emitting panel must have a certain thickness.

To provide thinner light-emitting panels, it is well-known to use light-emitting diodes (LEDs). An array of LEDs may then be arranged on a printed circuit board (PCB), which provides for a very compact (thin) light-emitting panel that can provide uniform light over a relatively large area.

This, however, becomes a costly solution, especially for very large panels, where the cost of the PCB may well be higher than the cost of the LEDs mounted on the PCB.

WO-2007/122566 provides an alternative way of providing an array of LEDs without using a costly PCB. According to WO-2007/122566, LEDs are instead mounted on an array of parallel electrically conducting wires. After attaching LEDs to mutually adjacent electrically conducting wires, the array of wires is stretched in the width direction to form an LED array grid.

Although WO-2007/122566 provides a cost-efficient way of producing large area LED arrays, it would be desirable to further improve the performance of the LED array, for example in terms of the mechanical properties thereof.

SUMMARY OF THE INVENTION

In view of the above-mentioned and other drawbacks of the prior art, a general object of the present invention is to provide an improved lighting module for a light-emitting panel, in particular a lighting module exhibiting improved mechanical properties.

According to a first aspect of the present invention there is thus provided a grid-shaped lighting module comprising: a plurality of electrically conducting wires defining a grid with nodes; and a plurality of solid-state light-sources each being arranged at a respective one of the nodes and connected to two electrically conducting wires of the plurality of electrically conducting wires, wherein the electrically conducting wires are pleated such that the grid-shaped lighting module exhibits a 3D-topography.

"Solid state light-sources" should, in the context of the present application, be understood to mean light-sources in which light is generated through recombination of electrons and holes. Examples of solid state light-sources include light-emitting diodes (LEDs) and semiconductor lasers.

The electrically conducting wires, which may advantageously be metal wires, may be bent to exhibit pleats. The pleats may be rounded or have more or less sharp corners depending on the properties of the electrically conducting wires and/or the intended use of the grid-shaped lighting module.

The locations of the solid state light-sources comprised in the grid-shaped lighting module may together, at least approximately, define a light-source surface in space, such as a plane or a curved plane, and the pleats may extend perpendicularly from the light-source surface.

The present invention is based on the realization that the mechanical stability of a wire-based grid-shaped lighting module can be improved by bending or pleating the electrically conducting wires, and that the resulting 3D topography of the grid-shaped lighting module can further be utilized for positioning the solid-state light-sources in relation to other parts of a light-emitting device and/or for protecting the solid-state light-sources.

In particular, various embodiments of the grid-shaped lighting device can increase the stiffness of an illumination panel when, for example, being sandwiched between a reflector and a diffuser.

In addition, the grid-shaped lighting module is an open structure which can be considered to be "acoustically transparent". Accordingly, the grid-shaped lighting module according to various embodiments of the present invention is highly suitable for use in light-emitting acoustic panels, since sound absorbing material can be arranged behind the panel, with the sound waves travelling freely through the grid-shaped lighting module to be absorbed by the sound absorbing material.

Furthermore, illumination panels comprising the grid-shaped lighting module according to various embodiments of the present invention can be made thin, since the 3D topography of the grid-shaped light-source array can be used to space the solid state light-sources away from a reflective sheet, which will increase the spread of light so that a thinner illumination panel can be configured to emit uniform light.

Additionally, an improved heat dissipation can be provided since the heat exchange area is increased for a given density of solid-state light-sources. Heat dissipation can even be further improved by stapling the 3D structure to a heat sink. In general, the 3D structure allows for easy attachment of components to the grid-shaped lighting module.

According to various embodiments of the present invention, each of the electrically conducting wires may further be pleated such as to exhibit a plurality of pleats, each being arranged between two mutually adjacent solid state light-sources.

By arranging pleats between mutually adjacent solid state light-sources, the pleats can conveniently be used for spacing the solid state light-sources in relation to another structural or optical element, such as, a reflector and/or a diffuser. The pleats may all have substantially the same extension from a light-source surface defined by the solid state light-sources to provide for substantially the same distance between all solid state light-sources and another element or the pleats may exhibit different extensions from the light-source surface if a spatially varying distance is desired.

For added reliability in the spacing, each of the electrically conducting wires may be pleated such as to exhibit at least one pleat between each mutually adjacent pair of solid state light-sources connected to the electrically conducting wire.

According to various embodiments, furthermore, each of the electrically conducting wires may exhibit a plurality of pleats, at least three pleats being arranged between two mutually adjacent solid state light-sources.

Hereby, the pleats may be configured such that reliable spacing functionality can be achieved both "upwards" and "downwards" from the light-source surface. This is particularly the case where the pleats are arranged as so-called accordion pleats, that are, pointing in alternating directions.

The spacing can be achieved without additional components, only using the electrically conducting wires. It may, however, be advantageous to add further spacing components to avoid a shadow effect where the electrically conducting wires contact the structure from which the grid-shaped lighting module should be spaced. Such further spacing components should preferably be optically transparent and may be comprised in the structure from which the grid-shaped lighting module should be spaced or be added to the grid-shaped lighting module during production thereof.

The term "optically transparent" should be understood to mean "allowing at least a fraction of incident light to pass", and includes "completely" transparent as well as partly transparent (translucent).

Also for other embodiments, it may be advantageous, both from a functionality point-of-view and from a manufacturing point-of-view, to form the pleats as accordion pleats.

The grid-shaped lighting module according to various embodiments of the present invention may, moreover, advantageously be comprised in a light-emitting device, further comprising a first optically transparent sheet, and a second sheet, wherein the grid-shaped lighting module is sandwiched between the first and second sheets and arranged in such a way that light emitted by the solid state light-sources passes through the first sheet.

The light-emitting device may, for example, be a large area illumination panel. Such large area illumination panels may, for instance, be used in office or home environments as, for example, daylight replacement.

According to various embodiments, the second sheet may have a reflective side facing the grid-shaped lighting module; and the grid-shaped lighting module may be arranged in such a way that the solid state light-sources are oriented to emit light towards the reflective side of the second sheet, where it is reflected towards the first sheet.

It is a general rule-of-thumb that the distance between the solid-state light sources and a diffuser sheet should be approximately equal to the pitch of the solid state light-sources to provide for a uniform light pattern. By using the 3D topography of the grid-shaped lighting module according to various embodiments of the present invention for spacing the solid state light-sources apart from a reflective sheet opposite the diffuser sheet, the optical distance between the light-sources and the diffuser sheet can be increased, which provides for a thinner illumination panel that still provides uniform illumination.

According to various embodiments, the light-emitting device may further comprise a cellular spacing structure sandwiched between the first sheet and the second sheet, the cellular spacing structure forming a plurality of cells between the first sheet and the second sheet; and the grid-shaped lighting module may be arranged such that each of the solid state light-sources comprised in the grid-shaped lighting module is provided in a corresponding one of the cells.

The cellular spacing structure, which may be a honeycomb structure, may add to the structural strength of the light-emitting device and may further provide support for the grid-shaped lighting module. In addition, the walls of the cellular spacing structure may reduce glare of the light-emitting device.

In particular, the grid-shaped lighting module may be configured such that each electrically conducting wire exhibits at least one pleat between each mutually adjacent pair of solid state light-sources, such as LEDs. The spacing of the pleats may be adapted to the spacing of the cellular walls of the honeycomb-like structure so that the pleats can be used to position the solid state light-sources in the cells of the honeycomb-like structure.

According to a further embodiment, each of the electrically conducting wires of the grid-shaped lighting module may exhibit a plurality of pleats, at least three pleats being arranged between two mutually adjacent solid state light-sources; and the grid-shaped lighting module may be sandwiched between the first sheet and the second sheet in such a way that at least one of the pleats makes contact with one of the first and second sheets and at least two of the pleats make contact with the other one of the first and second sheets.

According to a second aspect of the present invention, there is provided a method of manufacturing a grid-shaped lighting module having a 3D topography, comprising the steps of: arranging a plurality of electrically conductive wires in parallel to create an array of wires having a width extending in a width direction perpendicular to a length direction of the wires, the width direction and length direction defining an initial array surface; arranging a plurality of solid state light-sources on the array of wires such that each of the solid state light-sources is electrically coupled to at least two mutually adjacent wires; pleating the array of wires to form pleats extending in a direction perpendicular to the initial array surface; and stretching the array of wires such that the width of the array of wires increases.

This method provides a convenient and rational way of manufacturing a grid-shaped solid state light-source array having a 3D topography.

Further effects and variations of the method according to various embodiments of the present invention are largely analogous to those provided above in relation to the first aspect of the present invention.

BRIEF DESCRIPTION OF THE DRAWINGS

These and other aspects of the present invention will now be described in more detail, with reference to the appended drawings showing currently preferred embodiments of the invention, wherein:

FIG. 4 is a flow-chart of a manufacturing method according to an exemplary embodiment of the present invention; and FIGS. 5*a-c* schematically illustrate the result of the corresponding steps of the method of FIG. 4.

DESCRIPTION OF A EXAMPLE EMBODIMENT OF THE PRESENT INVENTION

Figure 1:
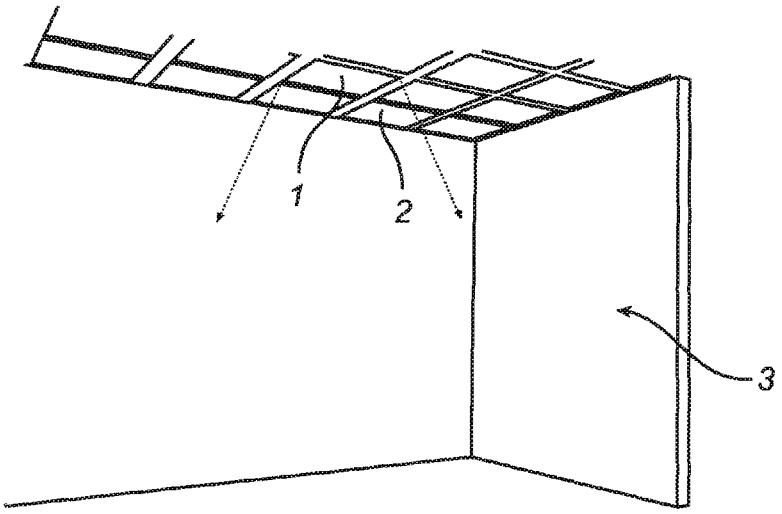
FIG. 1 schematically shows an exemplary application of the light-emitting panel according to various embodiments of the present invention, in the form of a light-emitting panel for illumination of a room.

FIG. 1 schematically illustrates an exemplary application for embodiments of the grid-shaped lighting module according to embodiments of the present invention, in the form of a light-emitting panel 1 arranged in a ceiling 2 of a room 3. The light-emitting panel 1 may be intended as daylight replacement and should then emit uniform white light.

Figure 2:
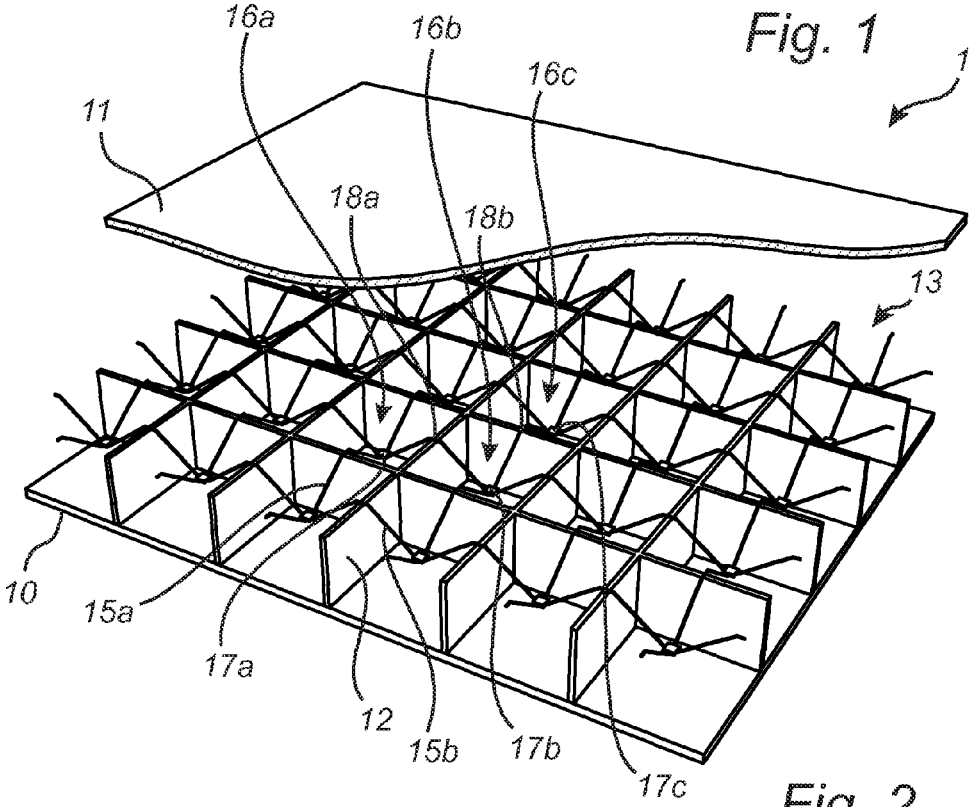
FIG. 2 is a schematic and partly cut out perspective view of a light-emitting panel according to a first embodiment of the present invention.

With reference to FIG. 2, which is a schematic perspective cutaway view of the light-emitting panel in FIG. 1, the light-emitting panel 1, according to a first exemplary embodiment, comprises a first sheet in the form of a diffuser foil 10 (or remote phosphor film), a second sheet in the form of a reflector foil 11, a honeycomb-like support structure 12 and a grid-shaped lighting module 13. The honeycomb-like support structure 12 and the grid-shaped lighting module 13 are sandwiched between the diffuser foil 10 and the reflector foil 11 as shown in FIG. 2.

As is also indicated in FIG. 2, the grid-shaped lighting module 13 comprises a plurality of electrically conducting wires, here metal wires 15*a-b* (only two of the wires have been assigned with reference numerals to avoid cluttering the drawing) defining a grid with nodes 16*a-c*, and a plurality of solid state light-sources, here LEDs 17*a-c* each being arranged at a respective one of the nodes 16*a-c* and electrically and mechanically connected to the mutually adjacent metal wires at the nodes 16*a-c*. As can also be seen in FIG. 2, the metal wires 15*a-b* have been bent so as to exhibit pleats 18*a-b* (only the pleats on one of the metal wires have been assigned with reference numerals) between mutually adjacent LEDs 17*a-c* connected to the metal wires.

The grid-shaped lighting module 13 is supported by the walls of the honeycomb-like support structure 12 at the pleats 18*a-b* so that the LEDs 17*a-c* are spaced between the diffuser foil 10 and the reflector foil 11 and directed towards the reflector foil 11. In this manner, light emitted by the LEDs 17*a-c* will travel from the LEDs 17*a-c* to the reflector foil 11 and then from the reflector foil 11 to the diffuser foil 10, which means that the light emitting panel 1 can be made relatively thin and still provide uniform illumination.

It should be noted that FIG. 2 (as well as FIG. 3 referred to below) is a simplified illustration of the light-emitting panel 1 in FIG. 1, and that various structures, such as a driver and electrical connector(s) for the grid-shaped lighting module and structures for mounting the light-emitting panel 1 in the ceiling 2, are not explicitly indicated. Such structures can, however, be provided in many different ways apparent to one skilled in the art. The light-emitting panel may also advantageously comprise sound absorbing material.

Figure 3:
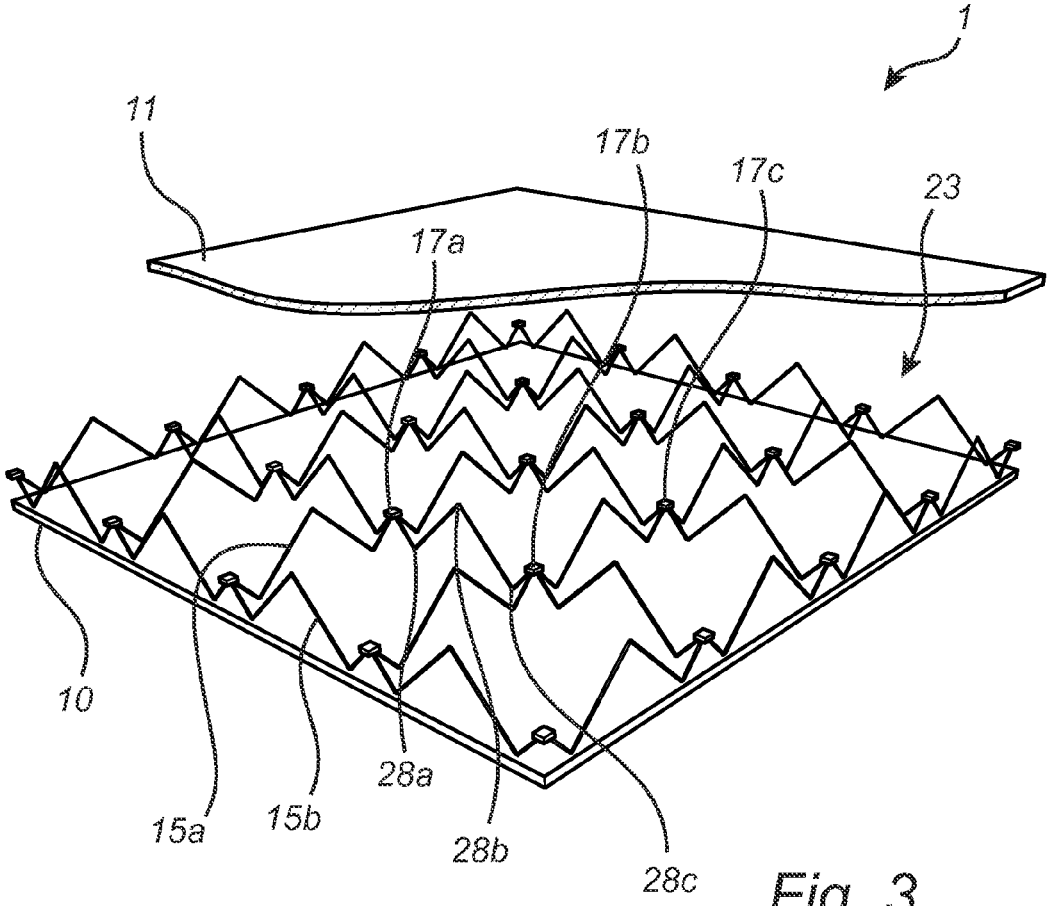
FIG. 3 is a schematic and partly cut out perspective view of a light-emitting panel according to a second embodiment of the present invention.

FIG. 3 schematically shows a light-emitting panel 1 according to a second exemplary embodiment, which differs from the first embodiment described above with reference to FIG. 2 in that it has no cellular support structure and in that the configuration of the grid-shaped lighting module is different. In the grid-shaped lighting module 23 of FIG. 3, the metal wires 15*a-b* are bent to exhibit three pleats 28*a-c* between mutually adjacent LEDs 17*a-c*. The pleats 28*a-c*, as in the embodiment of FIG. 2, are accordion pleats and comprise a center pleat 28*b* directed towards the reflector foil 11 and two side pleats 28*a,c* directed towards the diffuser foil 10. In the presently illustrated exemplary embodiment, the absolute amplitudes of the side pleats 28*a,c* are equal and smaller than that of the center pleat 28*b*. Hereby, the LEDs 17*a-c* can be reliably spaced apart from both the reflector foil 11 and the diffuser foil 10 without the need for further spacing means. It may, however, be beneficial to add an optically clear spacing structure or "stand off" between the side pleats 28*a,c* and the diffuser foil 10 to avoid shadow effects from the metal wires 15*a-b*.

Finally, an exemplary method of manufacturing the grid-shaped lighting module 13 in FIG. 2 will be described below with reference to the flow-chart in FIG. 4 and FIGS. 5*a-c*. The grid-shaped lighting module 23 in FIG. 3 is manufactured using the same method, the only difference being the number and configuration of the pleats 28*a-c*.

In a first step 100, there is provided an initial array 30 of electrically conducting wires, here metal wires 15*a-b*, with solid state light-sources, here LEDs 17*a-c* mechanically and electrically connected to mutually adjacent ones of the metal wires. The LEDs 17*a-c* may, for example, be soldered to the wires 15*a-b*. Methods for providing the initial array 30 are described in detail in WO-2007/122566, which is hereby incorporated by reference in its entirety.

In the subsequent step 101, the wires 15*a-b* of the initial array 30 are bent to form pleats 18*a-b* between mutually adjacent LEDs 17*a-c*.

Finally, in step 102, the initial array 30 is stretched in a width direction perpendicular to the direction of the length extension of the metal wires 15*a-b* in the initial array 30. As a result, the grid-shaped lighting module 13 of FIG. 2 is formed.

Additionally, variations to the disclosed embodiments can be understood and effected by the skilled person in practicing the claimed invention, from a study of the drawings, the disclosure, and the appended claims. For example, the grid-shaped lighting module may be pleated in other configurations.

In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A grid-shaped lighting module comprising:

a plurality of electrically conducting wires defining a grid with nodes, each node defined by an intersection of two mutually adjacent and transverse electrically conducting wires of the plurality of electrically conducting wires; and a plurality of solid-state light-sources each being arranged at a respective one of the nodes and connected to two electrically conducting and transverse wires of the plurality of electrically conducting wires that define the respective one of the nodes, wherein the electrically conducting wires are pleated such that the grid-shaped lighting module exhibits a 3D-topography, and wherein each of the electrically conducting wires is pleated such as to exhibit a plurality of pleats, each being arranged between two mutually adjacent solid state light-sources, and at least one pleat being arranged between each mutually adjacent pair of solid state light-sources connected to the electrically conducting wire.

2. The grid-shaped lighting module according to claim 1, wherein at least three pleats being arranged between two mutually adjacent solid state light-sources.

3. The grid-shaped lighting module according to claim 1, wherein each of the electrically conducting wires is pleated such as to exhibit accordion pleats.

4. The grid-shaped lighting module according to claim 1, wherein each of the solid state light-sources is an LED.

5. A light-emitting device, comprising:

a first sheet, the first sheet being optically transparent;

a second sheet; and the grid-shaped lighting module according to claim 1, sandwiched between the first sheet and the second sheet and arranged in such a way that light emitted by the solid state light-sources passes through the first sheet.

6. The light-emitting device according to claim 5, wherein the first sheet is configured to transmit light diffusely.

7. A light-emitting device, comprising:

a first sheet, the first sheet being optically transparent;

a second sheet;

a plurality of electrically conducting wires defining a grid with nodes, the grid with nodes being sandwiched between the first sheet and the second sheet; and a plurality of solid-state light-sources each being arranged at a respective one of the nodes and connected to two electrically conducting wires of the plurality of electrically conducting wires;

wherein the electrically conducting wires are pleated such that the grid-shaped lighting module exhibits a 3D-topography, wherein each of the electrically conducting wires is pleated such as to exhibit a plurality of pleats, each being arranged between two mutually adjacent solid state light-sources, and at least one pleat being arranged between each mutually adjacent pair of solid state light-sources connected to the electrically conducting wire;

wherein the second sheet has a reflective side facing the grid-shaped lighting module; and wherein the grid-shaped lighting module is arranged in such a way that the solid state light-sources are oriented to emit light towards the reflective side of the second sheet, where it is reflected towards the first sheet.

8. A light-emitting device, comprising:

a first sheet, the first sheet being optically transparent;

a second sheet;

a plurality of electrically conducting wires defining a grid with nodes, the grid with nodes being sandwiched between the first sheet and the second sheet; and a plurality of solid-state light-sources each being arranged at a respective one of the nodes and connected to two electrically conducting wires of the plurality of electrically conducting wires;

wherein the electrically conducting wires are pleated such that the grid-shaped lighting module exhibits a 3D-topography, wherein each of the electrically conducting wires is pleated such as to exhibit a plurality of pleats, each being arranged between two mutually adjacent solid state light-sources, and at least one pleat being arranged between each mutually adjacent pair of solid state light-sources connected to the electrically conducting wire;

wherein the light-emitting device further comprising a cellular spacing structure sandwiched between the first sheet and the second sheet, the cellular spacing structure forming a plurality of cells between the first sheet and the second sheet; and wherein the grid-shaped lighting module is arranged such that each of the solid state light-sources comprised in the grid-shaped lighting module is provided in a corresponding one of the cells.

9. The light-emitting device according to claim 8, wherein the cellular spacing structure is a honeycomb structure;

wherein each of the electrically conducting wires of the grid-shaped lighting module is pleated such as to exhibit at least one pleat between each mutually adjacent pair of solid state light-sources connected to the electrically conducting wire; and wherein each of the pleats is supported by a wall of the honeycomb structure.

10. A light-emitting device, comprising:

a first sheet, the first sheet being optically transparent;

a second sheet;

a plurality of electrically conducting wires defining a grid with nodes, the grid with nodes being sandwiched between the first sheet and the second sheet; and a plurality of solid-state light-sources each being arranged at a respective one of the nodes and connected to two electrically conducting wires of the plurality of electrically conducting wires;

wherein the electrically conducting wires are pleated such that the grid-shaped lighting module exhibits a 3D-topography, wherein each of the electrically conducting wires is pleated such as to exhibit a plurality of pleats, each being arranged between two mutually adjacent solid state light-sources, and at least one pleat being arranged between each mutually adjacent pair of solid state light-sources connected to the electrically conducting wire;

wherein each of the electrically conducting wires of the grid-shaped lighting module exhibits a plurality of pleats, at least three pleats being arranged between two mutually adjacent solid state light-sources; and wherein the grid-shaped lighting module is sandwiched between the first sheet and the second sheet in such a way that at least one of the pleats makes contact with one of the first and second sheets and at least two of the pleats make contact with the other one of the first and second sheets.

11. A method of manufacturing a grid-shaped lighting module having a 3D topography, comprising the steps of:

arranging a plurality of electrically conductive wires to create a grid with nodes, each node defined by an intersection of two mutually adjacent electrically conducting wires of the plurality of electrically conductive wires, wherein the grid has a width extending in a width direction perpendicular to a length direction of the wires, the width direction and length direction defining an initial array surface;

arranging a plurality of solid state light-sources on the array of wires such that each of the solid state light-sources is electrically coupled to at least two adjacent wires defining a node of the grid;

pleating the array of wires to form pleats extending in a direction perpendicular to the initial array surface, wherein each of the electrically conducting wires is pleated such as to exhibit a plurality of pleats, each being arranged between two mutually adjacent solid state light-sources, and at least one pleat being arranged between each mutually adjacent pair of solid state light-sources connected to the electrically conducting wire; and stretching the array of wires such that the width of the array of wires increases.

* * * * *